US008965022B2

(12) United States Patent
Zhou et al.

(10) Patent No.: US 8,965,022 B2
(45) Date of Patent: Feb. 24, 2015

(54) PERSONALIZED DISPLAY

(75) Inventors: Xiaoqi Zhou, San Diego, CA (US); David P Rossing, Poway, CA (US); Stephen Martin Ladak, Santee, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 312 days.

(21) Appl. No.: 13/435,376

(22) Filed: Mar. 30, 2012

(65) Prior Publication Data

US 2013/0259270 A1 Oct. 3, 2013

(51) Int. Cl.
*H04R 1/02* (2006.01)
*H04R 9/06* (2006.01)

(52) U.S. Cl.
USPC ..... 381/333; 381/87; 381/332; 381/388

(58) Field of Classification Search
USPC ..... 381/190, 332–334, 388, 424–426, 428, 381/431
See application file for complete search history.

(56) References Cited

U.S. PATENT DOCUMENTS

| | | | | |
|---|---|---|---|---|
| 5,504,836 | A * | 4/1996 | Loudermilk | 704/272 |
| 5,513,455 | A * | 5/1996 | Walker | 40/788 |
| 6,181,799 | B1 * | 1/2001 | Azima et al. | 381/152 |
| 6,443,586 | B1 | 9/2002 | Azima et al. | |
| 6,516,071 | B1 | 2/2003 | Liu | |
| 6,911,901 | B2 | 6/2005 | Bown | |
| 7,502,694 | B2 | 3/2009 | Booth | |
| 7,639,826 | B1 | 12/2009 | Azima et al. | |
| 8,064,629 | B2 | 11/2011 | Jiang | |
| 2005/0157905 | A1 | 7/2005 | Beer et al. | |
| 2007/0036388 | A1 * | 2/2007 | Lee et al. | 381/431 |
| 2011/0016759 | A1 * | 1/2011 | Ramos-Gonzalez et al. | 40/773 |
| 2011/0199315 | A1 | 8/2011 | Kent et al. | |
| 2011/0258893 | A1 | 10/2011 | Mayer et al. | |

FOREIGN PATENT DOCUMENTS

CN 201833679 U 5/2011

OTHER PUBLICATIONS

"Basic principles of exciter-technology"; The Loudspeaker Specialist; Visaton Germany; 4 pages.
"What is Bending Wave Technology and How Can it Improve Student Achievement?"; LightSPEED Technologies; Jan. 2008; 7 pages.

* cited by examiner

*Primary Examiner* — Matthew Eason
(74) *Attorney, Agent, or Firm* — Hewlett-Packard Patent Department

(57) ABSTRACT

In one embodiment, a kit for making a personalized display includes a blank foldable to form a cavity according to score lines to form a display with a cavity, a print medium to receive a user selected-image and to adhere to the blank, and a bending wave generation unit attachable to a display element to receive a signal from a signal generator and produce bending waves within the display element that cause the display element to vibrate and generate audible acoustic waves in accordance with the signal. In another embodiment, a personalized display includes a blank with extensions folded to form a cavity, a print medium adhered to the blank and with a user-selected image printed via a digital printer, and a bending wave generation unit attached to a display element and positioned within the cavity.

11 Claims, 4 Drawing Sheets

PERSONALIZED DISPLAY

BACKGROUND

Electronic audio devices such as radios, stereo systems, and entertainment systems, have the capability of producing audible sounds such as talk and music for enjoyment by a user.

BRIEF DESCRIPTION OF THE DRAWINGS

The accompanying drawings illustrate various embodiments and are a part of the specification. The illustrated embodiments are examples and do not limit the scope of the claims. Throughout the drawings, identical reference numbers designate similar, but not necessarily identical elements.

The same part numbers designate the same or similar parts throughout the figures.

DETAILED DESCRIPTION OF EMBODIMENTS

The radios, stereo systems, and entertainment systems, and other sound systems available to consumers are typically generic in appearance and thus may be deemed by users as unattractive for a home or office. Such audio devices are often box-like and metallic in appearance and are thus quite noticeable in a household or office in comparison with other room accessories. Further, the radios, stereo devices and other audio device produced by manufacturers and sold to consumers typically will closely resemble each other, such that the aesthetics issues are compounded when a household or office has multiple audio devices. For these reasons, users are will appreciate a personalizable, esthetically pleasing audio device that will complement household and office décor.

Accordingly, various embodiments described herein were developed to provide a personalized display with a bending wave generation unit to cause the generation of audible acoustic waves, and a kit for assembling the personalized display. The personalized display in addition to serving as a generator of acoustic waves for listening pleasure, functions as a stand-alone household decoration or as a hanging wall decor. Examples of the disclosure include three dimensional faux canvas display created using a user-selected image printed via a digital printer. The display includes a bending wave generation unit ("BWGU") to receive a signal from a signal generator, and to produce bending waves within a display element and cause the display element to vibrate and generate audible acoustic waves in accordance with the signal. In an example kit and display, the BWGU is attached to a blank included with the display, such that the blank is vibrated to create the acoustic wave. In another example kit and display, the BWGU is attached to a support element that is to be positioned at least partially within a cavity formed by the folded blank, and is attached to the folded blank, such that the support element is vibrated to create the acoustic wave. Advantages of the disclosure include that a user can create an inexpensive, personalized artwork that performs the functions of one or more sound-producing devices, thereby reducing the number of generic audio devices to be managed, and hidden away when not used. As the sound-producing device is also a personalized and aesthetically pleasing or comforting artwork, user satisfaction is increased.

As used in this application, a "printer" or "printing device" refers to any liquid inkjet printer, solid toner-based printer, liquid toner-based printer, solid ink printer, or any other electronic device that prints." "Printer" or "printing device" includes any multifunctional electronic device that performs a function such as scanning and/or copying in addition to printing.

Figure 1:
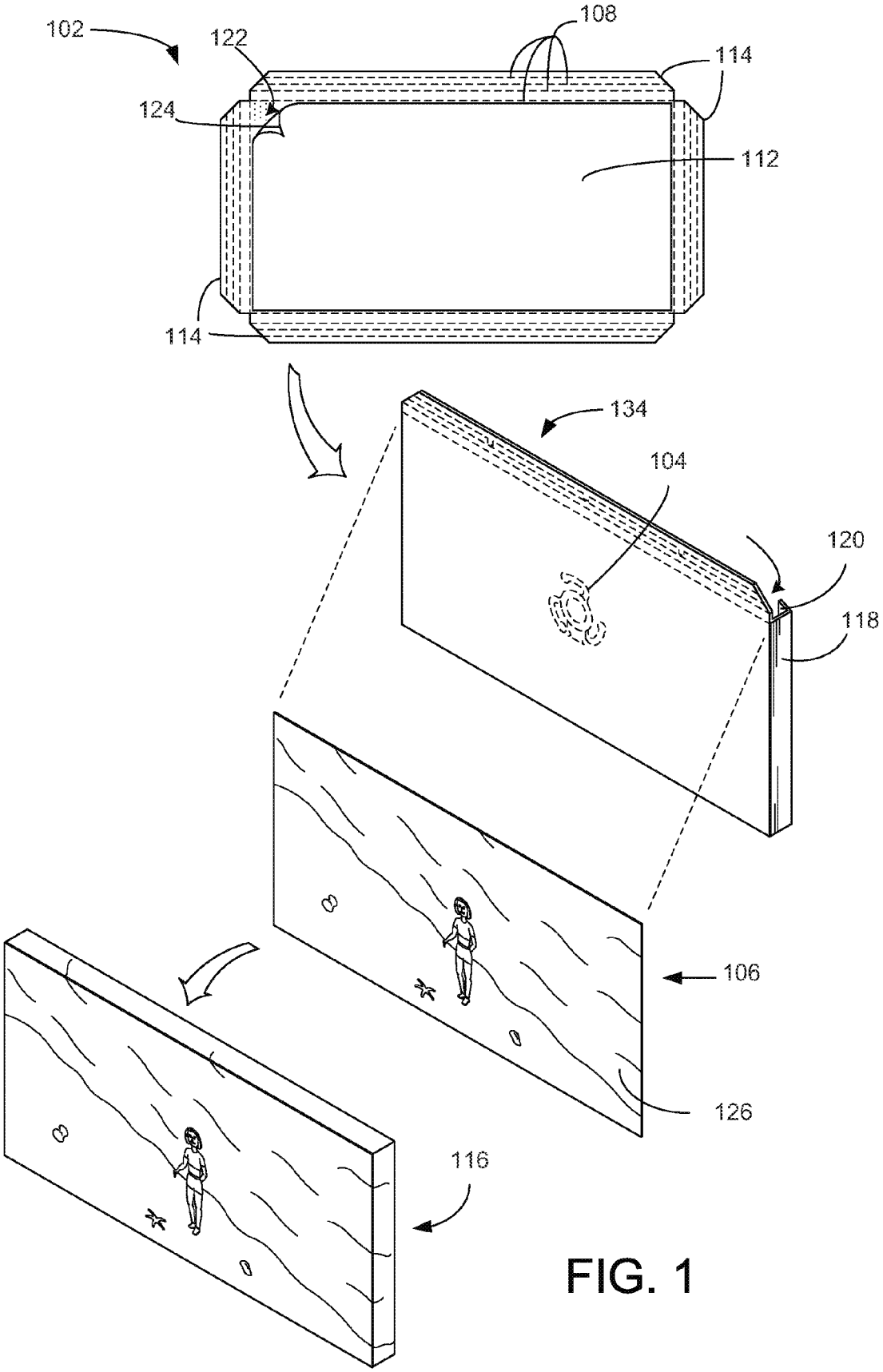
FIG. 1 provides views of a foldable blank, a bending wave generation unit, a personalized print medium, and an assembled display according to various embodiments.

FIG. 1 provides views of a kit to form a personalized display with a BWGU, and an assembled display, according to various embodiments. The kit of FIG. 1 includes a foldable blank 102, a BWGU 104, and a personalizable print medium 106. In an example, the blank 102 may be blank that includes that includes score lines 108 and is foldable according to the score lines 108 to form a cavity 110. In certain embodiments, the folding of the blank 102 is such that the cavity is formed in the shape of a concave. In an example, the blank 102 may be a cellulose product, such as a cellulose card stock, corrugated fiberboard or other paperboard. In other examples, the blank 102 may be made of any lightweight foldable material, including, but not limited to a pure element such as an aluminum foil, a compound of multiple elements such as a copper-zinc alloy foil, a synthetic polymer such a polypropylene, or a composite such as PET/$CaCO_3$ coextruded sheet.

Continuing with the example of FIG. 1, the blank 102 includes a center portion 112 and four extensions 114 connected to the center portion 112, with each extension to be folded four times according to the score lines 108 on the extension 114 to form a rectangular polygon display 116. In other examples, the blank is configured to, when folded, form a frame or support for a display that is other than a rectangular polygon (e.g., a triangle, or an oval). In a certain example, each extension may be folded three times upon itself to form a frame or support for the display. In other examples, each extension may in a form to be folded more than four times upon itself. The blank 102 includes an adhesion surface 118 and a back surface 120 that is opposite the adhesion surface 118. The adhesion surface 118 is a surface to receive a personalized print medium 106.

In an example, the foldable blank 102 additionally includes an adhesive layer 122 established upon the adhesion surface 118. The adhesive layer 122 may be in the form of a glue, resin, or any other sticky material to promote adhesion of a personalized print medium to the adhesion surface 118 of the blank 102. In an example, the foldable blank 102 also includes a removable liner 124 positioned on the adhesive layer 122. The removable liner 124 is to keep the adhesive layer 122 from sticking to other kit or display materials, or a user, prior to the adhesive layer's intended use to cause adhesion of a personalized print medium 106 to the blank's adhesion surface 118.

The print medium 106 includes a personalization surface 126 to receive a user selected-image, and includes a rear surface 128 opposite the personalization surface 126 to adhere to the blank's adhesion surface 118. The print medium 106 may be in the form of, but is not limited to, a cellulose print medium or a polymeric print medium. In examples, the personalization surface 126 may be a smooth, glossy, shiny surface. In other examples, the personalization surface 126 may be in the form of a satin, matte or other textured surface. In one example, a satin personalization layer includes a matte agent with fillers in the personalization layer, e.g. ground calcium carbonate, clay or organic beads such as polyethylene dispersions. In an example, the matte agent has a large particle size (e.g., from about 20 μm to about 50 μm). In another example, the matte agent is a hollow polymeric particle, wherein from about 20% to 60% of particle volume is occupied by air voids.

The personalization surface 126 is to be personalized with a user-selected image. In examples, the user-selected image 128 is to be printed to the personalization surface using a digital printer. The digital printer used to print the user-selected image may be any type of printing device, including, but not limited to an inkjet printer, a piezoelectric printer, an electrophotographic printer, a liquid electrophotographic printer, or a solid ink dye-sublimation printer. In the example of FIG. 1, the personalization surface 126 of the print medium 106 is shown with a user-selected image that has been applied to the personalization surface with a digital printer. In this example, the printed personalization image includes an image of a child at the beach. In an example, the printed personalized image may be related to or indicative of the nature of the acoustic waves to be created and expressed by the personalized display 116. For instance, in the example of FIG. 1 the user-selected image of the child at the beach that is printed upon the print medium 106 may be indicative of the display's functionality to transmit acoustic waves of a recording of the child's voice. In another example, the user-selected printed image may be that of a baby, and the image is indicative of the display's functionality to express sounds received from a baby monitor located in that child's bedroom.

The partially-folded blank 134 illustrates the appearance of foldable blank 102 during a folding operation, prior to adhering of the rear surface 128 of the print medium 106 to the blank's adhesion surface 118. Partially folded-blank 134 illustrates a BWGU 104 that is attachable to display 116 and is to be at least partially contained within the cavity 110. The BWGU 104 is a system or unit to receive a signal from a signal generator and produce bending waves within a display element that will cause the display element to vibrate and generate audible acoustic waves in accordance with the signal. In an example kit and display, the display element is the blank 120, such that the BWGU 104 is attached to the back surface 120 of the blank and the blank is to be vibrated to cause the display element to vibrate and generate audible acoustic waves in accordance with the signal. In another example kit and display, the display element is a support element that is included with the display and attached to the blank. In this latter example, the BWGU 104 is attached to the support element and the support element is to be vibrated to cause the display element to vibrate and generate audible acoustic waves in accordance with the signal. Inclusion, or partial inclusion, of the BWGU 104 within the cavity 110 provides considerable advantages, including creating an aesthetically pleasing, attractive display in which the BWGU 104 and other electronics are partially hidden or hidden as a user interacts with the display 116. Another advantage of including, or partially including, the BWGU 104 within the cavity 110 is protection of the BWGU 104 from damage during use or transport of the display 116.

Figure 2:
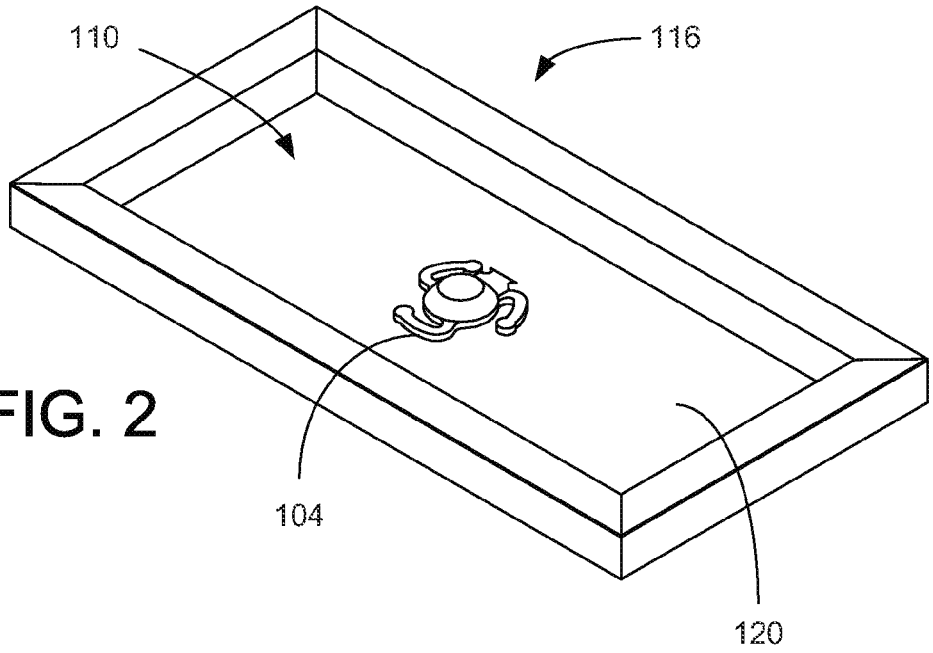
FIG. 2 is a back, perspective, exploded view of the assembled display of FIG. 1, according to various embodiments.
Figure 3:
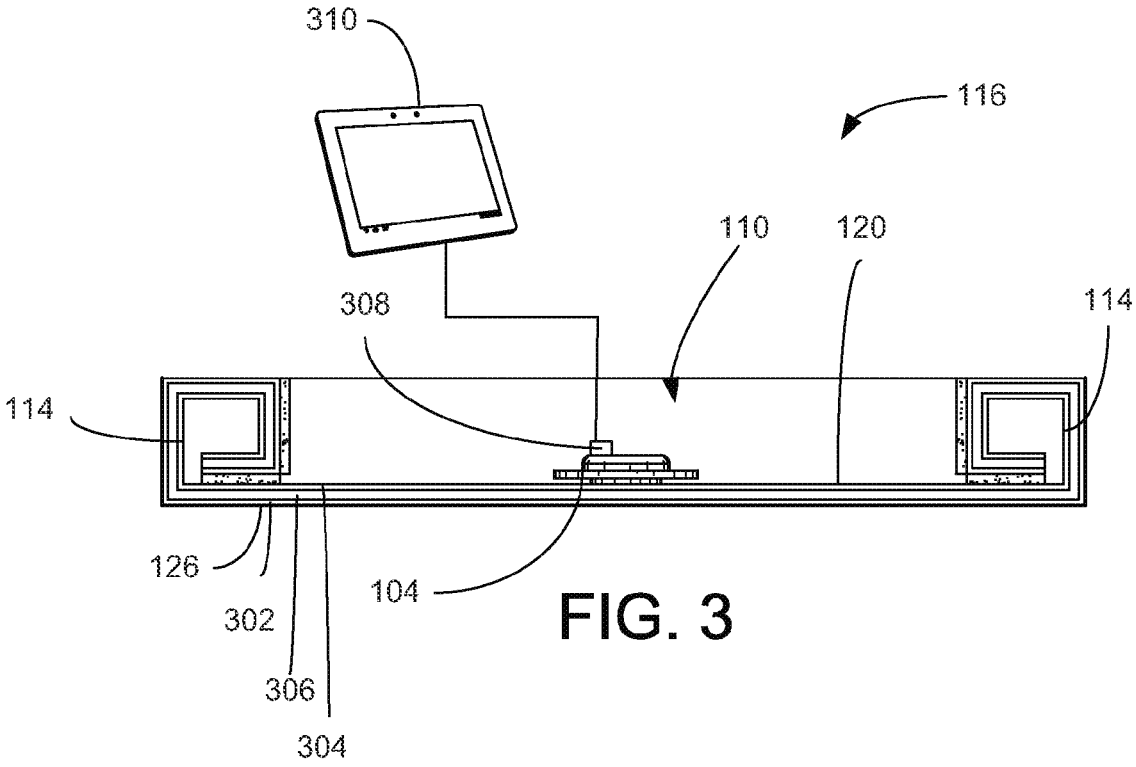
FIG. 3 is a cross-section view of the displays of FIGS. 1 and 2, according to various embodiments.

FIG. 2 is a back, perspective, exploded view of the assembled display of FIG. 1, according to various embodiments. FIG. 3 is a cross-section view of the assembled display of FIGS. 1 and 2, according to various embodiments. In the example of FIGS. 1-3, the BWGU 104 is attachable to the back surface 120 of the blank and positioned at least partially within the cavity 110. In the example of FIG. 3, the blank 102 has a first layer 302 and a second layer 304 that are non-corrugated and that include chemical pulped cellulose fibers and low moisture absorbing fibers. In this example, the blank 102 also has a third layer 306 that is corrugated, includes cellulose fibers and is situated between the first 302 and second 304 non-corrugated layers. In this example, the first 302, second 304 and third 306 layers are adhered to each other by a polymeric adhesive or a chemically treated starch.

The BWGU 104 receives a signal from a signal generator 310 and is to produce bending waves within the blank 102. The bending waves produced within the blank 102 are to cause the blank 102 to vibrate and generate audible acoustic waves in accordance with the signal. In an example, the signal the signal received by the BWGU 104 from the signal generator is an analog signal that communicates information descriptive of a sound, e.g., audible talk, sound effects, or music, via varying current or voltage along a circuit that includes the BWGU 104 and the signal generator. In an example, the BWGU 104 includes an amplifier to amplify the received analog signal.

The kit and display 116 of FIGS. 1-3 include an interface 308 to connect the BWGU 104 with the signal generator 310. In examples, the interface 308 may be any type of interface or connector or adapter to connect signal generators, components, or apparatuses, including, but not limited to, a cable, cable connectors, interface card, card slot and/or port. In another example, the interface 308 includes a wireless receiver such that the BWGU 104 can wirelessly receive a signal from the signal generator 310. In an example kit, the BWGU 104 is electronically connected to the signal generator via the interface. In another example kit, the BWGU 104 is unconnected, and is to be electronically connected, e.g., via the interface, to the signal generator 310 by a user that is assembling the display.

In an example kit, the BWGU 104 is attached to the back surface 120 of the blank. In another example kit, the BWGU 104 is to be attached to the back surface 120 by a user that is assembling the display 116. In an example kit, the BWGU 104 that is attached to the back surface 120 of the blank 102 is positioned within the cavity 110 when the display 116 is fully assembled. In an example kit, the BWGU 104 is attached to the back surface 120 of the blank and is positioned within the cavity 110 by a user during assembly of the display 116.

The BWGU 104 is to receive the signal from the signal generator 310. In an example, a kit includes a single BWGU 104 to be included within the display (e.g., attached to the back surface 120 of the blank 102 or attached to a support element that is attached to the back surface 120 of the blank). In another example, the assembled display 116 may include multiple BWGUs. In an example kit, the signal generator 310 that provides the audio signal is an electronic device that is not included within the kit, but which is attachable to the BWGU 104 via the interface 308 included within the kit. In the example of FIG. 3, the signal generator 310 to provide the audio signal to the BWGU 104 may be a notebook computer. In other examples, the signal generator 310 may be a tablet computer, radio, smartphone, MP3 player, stereo receiver, or any other audio signal generator.

In another example, the signal generator 310 to supply the audio signal to the BWGU 104 is a signal generator that is included within the kit. For instance, the signal generator 310 may be a radio receiver or MP3 player or other audio device to be included with the cavity 110 of the finished display 116 and cause an audio transmission of songs, speech, or other recorded content that is held in memory within the audio device. In another example, the signal generator 310 may be a radio receiver to be located within the cavity 110 of the finished display 116, the radio receiver to play audio content that is received at the receiver via electromagnetic waves.

Figure 4:
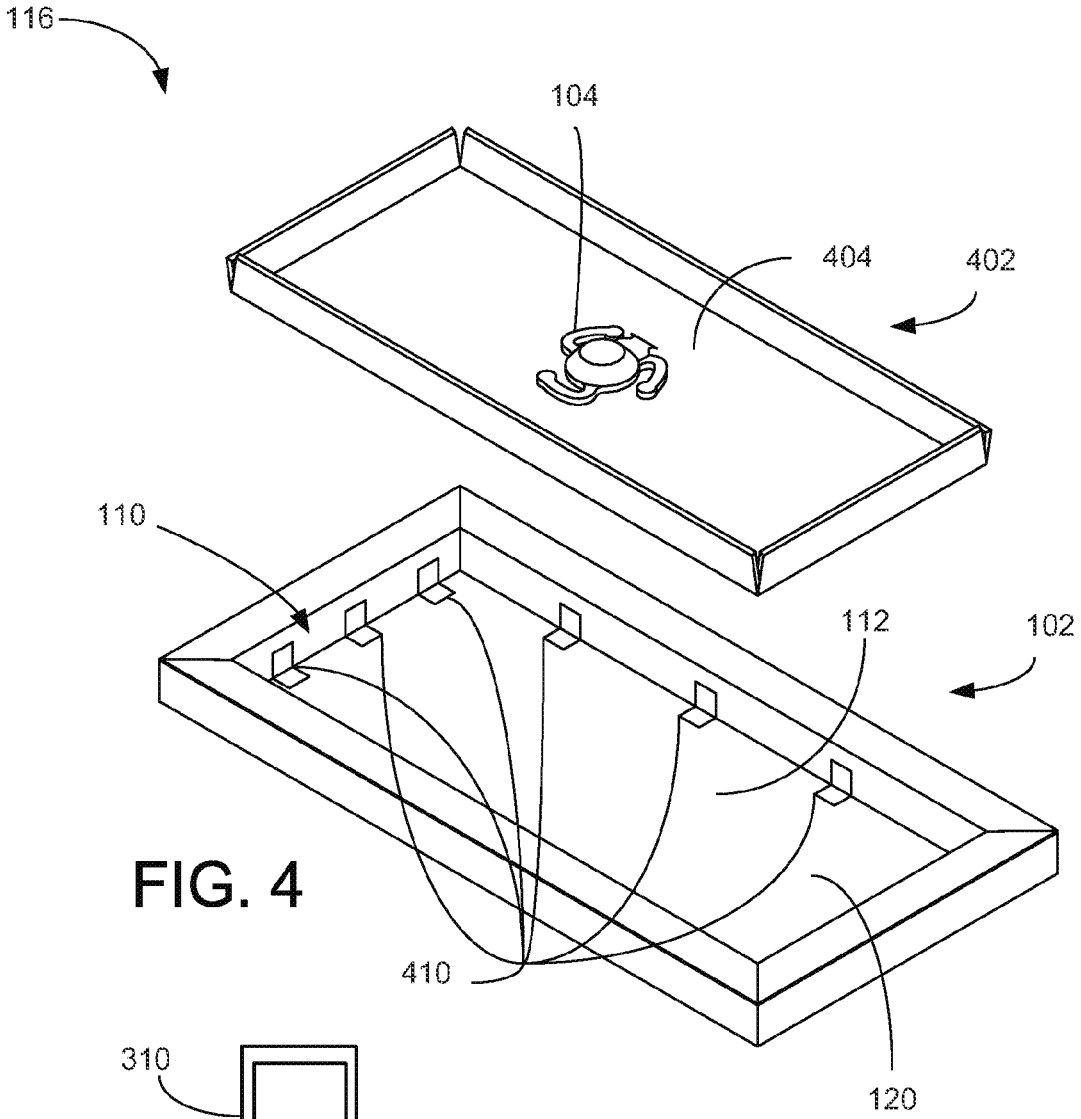
FIG. 4 is a back, perspective, exploded view of an assembled display including a folded blank and a support element to be secured to the folded blank, according to various embodiments.
Figure 5:
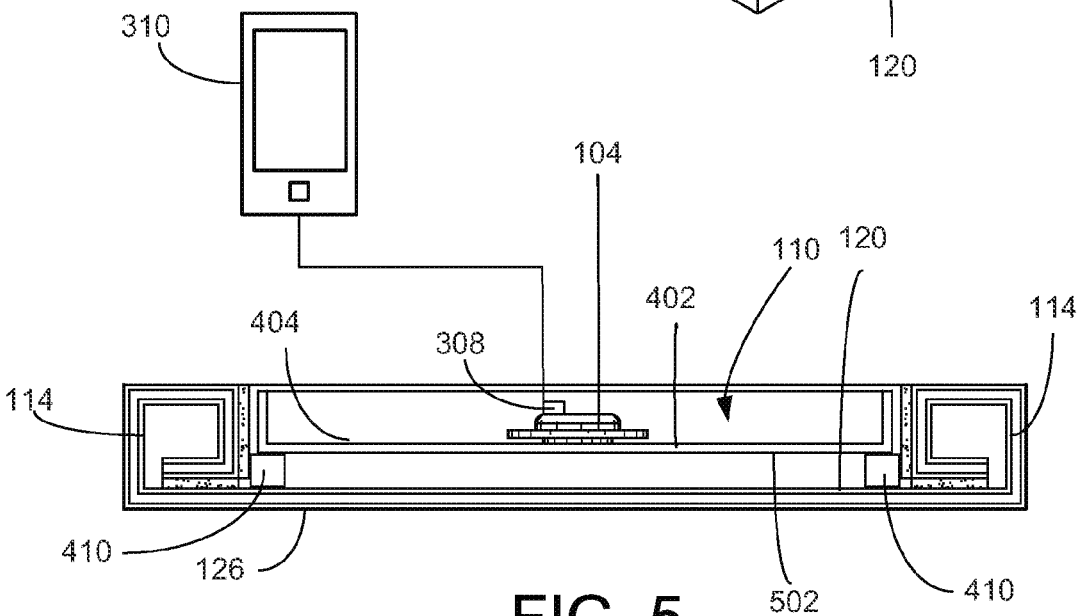
FIG. 5 is a cross-section view of the display of FIG. 4, according to various embodiments.
Figure 6:
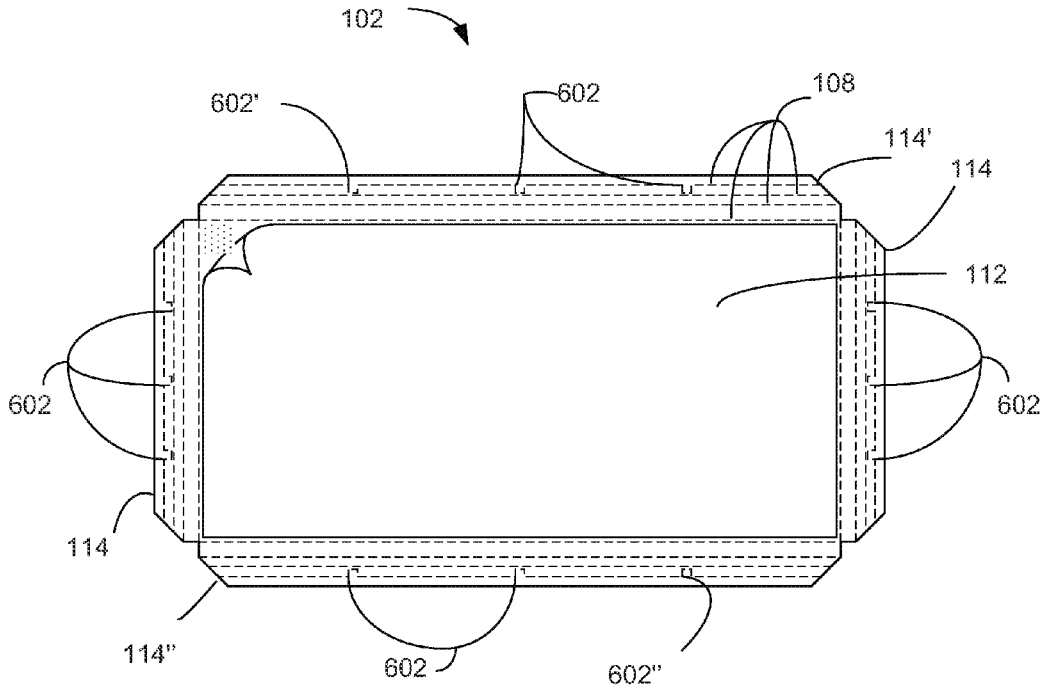
FIG. 6 provides a view of a blank with scored tabs to position a support element after folding of the blank, according to various embodiments.

Moving to FIGS. 4, 5, and 6, in other examples a kit includes a support material or support element 402, for insertion into the display 116 adjacent to the back surface 120 of a folded blank 102, and within the cavity 110 to provide structural and/or aesthetic advantages for the display 116. FIG. 4 is a back, perspective, exploded view of an assembled display 116 that includes a folded blank 102 and an inner support material 402 to be secured to the folded blank 102, according to various embodiments. FIG. 5 is a cross-section view of the assembled display 116 of FIG. 4, according to various embodiments.

In the examples of FIGS. 4 and 5, the BWGU 104 is attachable to the support element 402. In an example, the support element 402 insert may make the display 116 more sturdy and or allow for a larger display than would be possible without the insert. In the example illustrated in FIGS. 4 and 5, the BWGU 104 is attachable to a first side 404 of the insert 402 that is outward-facing when the display 116 is assembled.

In another example, the support element 402 insert may make for a more attractive display 116 by covering or partially covering the BWGU 104. In this example, the BWGU 104 is attachable to a second side 502 of the insert 402 that faces the back surface 120, i.e. is inward-facing when the display 116 is assembled. In this latter embodiment, it may be necessary to create a hole in the insert 402 to allow a cable or wire lead or leads to pass through the insert 402 and to connect the signal generator 310 to the BWGU 104 via the interface 308. The signal generator 310 of FIG. 5 is depicted as a smartphone, but can be any electronic device capable of sending an analog signal to the BWGU 104.

Returning to the example of the disclosure illustrated in FIGS. 4 and 5, the display 116 includes one or more spacer elements 410 that are securable to the back surface 120 of the blank 102 to position the support element 402 to not touch the center portion 112 of the blank 102. This arrangement minimizes interference with the bending wave or the acoustic wave. For instance, in an example in which the BWGU 104 is attached to the inserted support element 402 and the support element 402 is in contact with the center portion 112 of the blank 102, acoustic interference might result as the support element 402 vibrates and bumps against the center portion 112. The inclusion of the spacer elements 410 mitigates this contact to reduce the acoustic interference and cause the production of a crisper, more accurate replication of the sound in accordance with the signal from the signal generator 310. In another example in which the BWGU 104 is attached to the blank 102 and the center portion 112 of the blank 102 is contact with a support element 402, acoustic interference might also result as the center portion 112 vibrates and bumps against the support element. In this example, the inclusion of the spacer elements 410 would mitigate the contact between the support element 402 and the vibrating center portion 112, resulting in better sound quality.

In one example, a kit includes one or more spacer elements 410 that are to be installed by user between to the back surface 120 of the blank 102 and the support element 402. In examples, the spacer elements 410 include a plastic, polyurethane, foam, or other lightweight material. In an example, the spacer elements 410 are pre-attached either to the center portion 112 of the back 120 of the blank 102, or to the support element 402.

Moving to FIG. 6, in another example, the one or more spacer elements may be a tab or tabs 602 that are scored in the extensions 114 that are connected to center portion 112 of blank 102. In an example, a first tab 602' is scored in a first extension 114' among the four extensions 114, and a second tab 602" is scored in a second extension 114" among the four extensions. In the example of FIG. 6, each tabs are scored in each of the four extensions.

The tabs 602 are to be secured to the back surface of the blank 102 after folding of the blank 102 at the extensions 114 according to the scoring 108. The tabs are to be secured to the back surface 102 by a user after folding of the extensions 114 during assembly of the display 116. The secured tabs 602 are to position the support element 402 to not touch the center portion 112 of the blank 102 and thereby minimize interference with a bending wave (e.g., transmitting through the blank 102 or the support element 402) or an acoustic wave (produced by vibration of the blank 102 or the support element 402).

Various modifications may be made to the disclosed embodiments and implementations without departing from their scope. Therefore, the illustrations and examples herein should be construed in an illustrative, and not a restrictive, sense.

What is claimed is:

1. A kit for making a personalized display comprising:

a blank foldable according to score lines to form a display with a cavity, the blank including a center portion, and at least three extensions connected to the center portion, each extension to be folded at least three times according to the score lines to form the cavity;

an adhesion surface to receive a personalized print medium, and a back surface opposite the adhesion surface;

the print medium including a personalization surface to receive a user selected-image, and including a rear surface opposite the personalization surface to adhere to the blank's adhesion surface;

a support element attachable or attached to the folded blank, to be positioned at least partially within the cavity;

a bending wave generation unit attachable to the support element to receive a signal from a signal generator and produce bending waves within the support element that cause the support element to vibrate and generate audible acoustic waves in accordance with the signal; and a first spacer element and a second spacer element securable to the back surface to position the support element to not touch the center portion and thereby minimize interference with the bending wave or the acoustic wave, wherein the first spacer element is a first tab scored in a first extension among the at least three extensions, and the second spacer element is a second tab scored in a second extension among the at least three extensions, and the first and second tabs e to be secured to the back surface after folding of the at least three extensions.

2. The kit of claim 1, wherein the user-selected image is to be printed to the personalization surface using a digital printer chosen from an inkjet printer, a piezoelectric printer, an electrophotographic printer, a liquid electrophotographic printer, and a solid ink dye-sublimation printer.

3. The kit of claim 1, wherein the blank is to be folded into the form of a polygon.

4. The kit of claim 1, wherein the blank includes:

an adhesive layer established upon the adhesion surface; and a removable liner positioned on the adhesive layer.

5. The kit of claim 1, wherein the blank includes:

a first and a third layer including chemical pulped cellulose fibers and low moisture absorbing fibers;

a second layer positioned between the first and second layers, the second layer a corrugated layer including cellulose fibers; and wherein the first, second and third layers are adhered to each other by a polymeric adhesive or a chemically treated starch.

6. The kit of claim 1, wherein the unit includes an amplifier to amplify the signal.

7. The kit of claim 1, wherein the kit includes an interface to electronically connect the unit to the signal generator.

8. The kit of claim 7, wherein the interface includes a wireless receiver to wirelessly connect the unit to the signal generator.

9. The kit of claim 1, wherein the unit is connected to the signal generator.

10. An acoustic personalized display, comprising:

a blank including an adhesion surface and an opposed back surface, at least three sides, and an extension for each of the sides, with each extension folded towards the back surface at least three times according to score lines to form a cavity;

a print medium adhered to the adhesion surface, the medium including a personalization surface upon which a user-selected image has been printed via a digital printer, and including a rear surface opposite the personalization surface adhered to the blank's back surface;

a support element positioned adjacent to the back surface and within the cavity;

a bending wave generation unit attached to the support element and positioned within the cavity, the unit to produce bending waves in the support element accordance with a signal received from a signal generator, and the bending waves to cause the element to vibrate and generate representative audible acoustic waves conforming with the signal;

a first tab and a second tab secured to the back surface to position the support element to not touch the center portion, wherein the first tab was formed via scoring in a first extension among the at least three extensions, and the second tab was formed via scoring in a second extension among the at least three extensions; and an interface to electronically connect the unit to the signal generator.

11. A kit for making a personalized display, comprising:

a blank that is foldable according to score lines to form a display with a cavity, the blank including an adhesion surface to receive a personalized print medium, a back surface opposite the adhesion surface;

a center portion;

at least three extensions connected to the center portion, each extension to be folded at least three times according to the score lines on the extension;

an adhesive layer established upon the adhesion surface;

a removable liner positioned on the adhesive layer;

a first tab scored in a first extension among the at least three extensions, and a second tab scored in a second extension among the at least three extensions, the first and second tabs to be secured to the back surface after folding of the at least three extensions;

the print medium including a personalization surface to receive a user selected-image via a digital printer, and including a rear surface opposite the personalization surface to adhere to the blank's adhesion surface;

a support element to be positioned against the first and second tabs, not touching the center portion, and within the cavity;

a bending wave generation unit that is to be attached to the support element and positioned at least partially within the cavity, and electronically attached to a signal generator, and is to produce bending waves in the blank accordance with a signal received from the signal generator, the bending waves to cause the blank to vibrate and generate corresponding audible acoustic waves;

a first spacer dement and a second spacer dement securable to the back surface to position the support element to not touch the center portion and thereby minimize interference with the bending wave or the acoustic wave; and an interface to electronically connect the unit to the signal generator.

* * * * *

UNITED STATES PATENT AND TRADEMARK OFFICE

CERTIFICATE OF CORRECTION

PATENT NO. : 8,965,022 B2
APPLICATION NO. : 13/435376
DATED : February 24, 2015
INVENTOR(S) : Xiaoqi Zhou et al.

It is certified that error appears in the above-identified patent and that said Letters Patent is hereby corrected as shown below:

In the Claims,

In column 6, line 61, in Claim 1, delete “e” and insert -- are --, therefor.

In column 8, line 40, in Claim 11, delete “dement” and insert -- clement --, therefor.

In column 8, line 40, in Claim 11, delete “dement” and insert -- clement --, therefor.

Signed and Sealed this
Thirtieth Day of June, 2015

Michelle K. Lee

Michelle K. Lee
*Director of the United States Patent and Trademark Office*